US005148832A

United States Patent [19]

Lin

[11] Patent Number: 5,148,832

[45] Date of Patent: Sep. 22, 1992

[54] FAUCET HAVING RESILIENTLY-PACKED ROTATABLE SPOUT

[76] Inventor: Fu-Tung Lin, c/o Hung Hsing Patent Service Center, P.O. Box 55-1670, Taipei (10477), Taiwan

[21] Appl. No.: 783,231

[22] Filed: Oct. 28, 1991

[51] Int. Cl.[5] ..... E03C 1/02

[52] U.S. Cl. ..... 137/615; 137/801; 239/26; 285/279

[58] Field of Search ..... 137/615, 801; 239/26, 239/27; 285/279

[56] References Cited

U.S. PATENT DOCUMENTS

| | | | |
|---|---|---|---|
| 1,163,995 | 12/1915 | Frank | 285/279 |
| 1,236,457 | 8/1917 | Loomis | 285/279 |
| 1,727,301 | 9/1929 | Russell | 137/615 |
| 1,734,506 | 11/1929 | Walter | 137/615 X |
| 2,586,083 | 2/1952 | Poultney | 239/26 |
| 3,653,407 | 4/1972 | Katva | 137/615 |
| 4,778,108 | 10/1988 | Richards | 137/801 X |

*Primary Examiner*—Gerald A. Michalsky

[57] ABSTRACT

A faucet includes a spout having a shaft portion protruding inwardly from the spout to be rotatably engaged with a boss of the faucet; and two packing members disposed on two opposite sides of the boss having an outer packing member rotatably sealed between an annular shoulder portion of the spout and an outer seat portion of the boss, and having an inner packing member resiliently retained on an inner seat portion of the boss by a tensioning spring jacketed on the shaft portion which is protruded into an interior in the boss, thereby providing a resilient packing between the spout and the faucet for a smooth rotation of the spout for prolonging a service life of the packing members and the spout.

4 Claims, 2 Drawing Sheets

FAUCET HAVING RESILIENTLY-PACKED ROTATABLE SPOUT

BACKGROUND OF THE INVENTION

R. F. Poultney disclosed a fountain spigot in his U.S. Pat. No. 2,586,083 includes a spout 30 rotatably mounted in a boss 23 having a rubber collar 43sandwiched between an inner bearing sleeve 35 and an outer ring 27 provided within the boss 23. Such a rubber collar 43 may be easily worn during a rotative operation of the spout 30 about the boss 23 to cause loosening of the rotatable spout 30. In view of Poultney's valve plug for sealing the opening 20, a washer 21 is mounted on a bottom portion of the plug and the washer 21 may also be made of rubber material to well seal the opening 20. However, since a fountain valve is always or normally closed except for a temporary opening for water supply, the rubber plug is always subjected to a compression force against the valve seat to easily lose its elasticity, thereby being easily worn and reducing its sealing effect.

The present inventor has found the drawbacks of the conventional fountain spigot and invented the present faucet having a rotatable spout which is resiliently packed.

SUMMARY OF THE INVENTION

The object of the present invention is to provide a faucet including a spout having a shaft portion protruding inwardly from the spout to be rotatably engaged with a boss of the faucet; and two packing members disposed on two opposite sides of the boss having an outer packing member rotatably sealed between an annular shoulder portion of the spout and an outer seat portion of the boss, and having an inner packing member resiliently retained on an inner seat portion of the boss by a tensioning spring jacketed on the shaft portion which is protruded into an interior in the boss, thereby providing a resilient packing between the spout and the faucet for a smooth rotation of the spout for prolonging a service life of the packing members and the spout.

DETAILED DESCRIPTION

Figure 1:
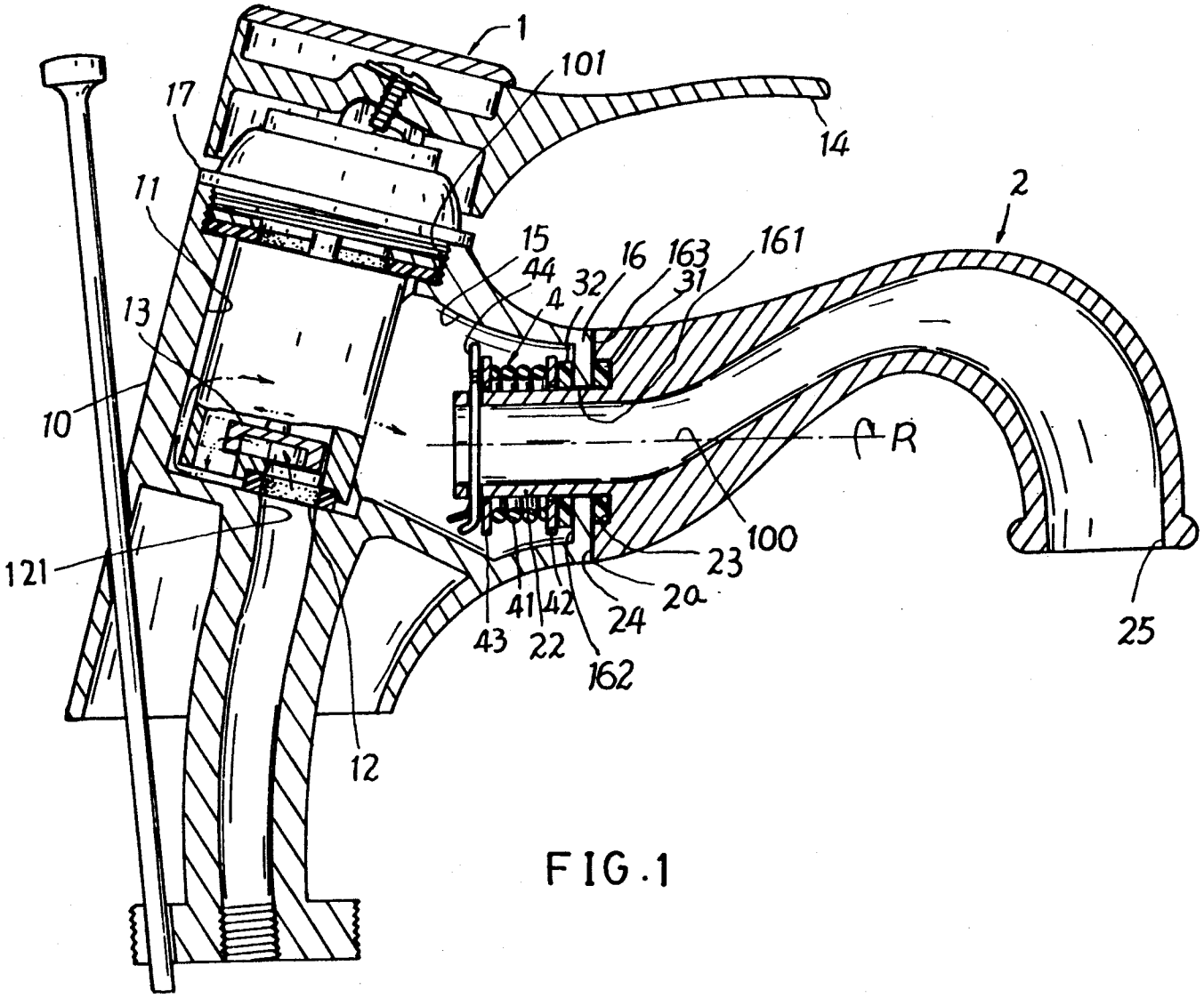
FIG. 1 is a sectional drawing of the present invention when assembled.
Figure 2:
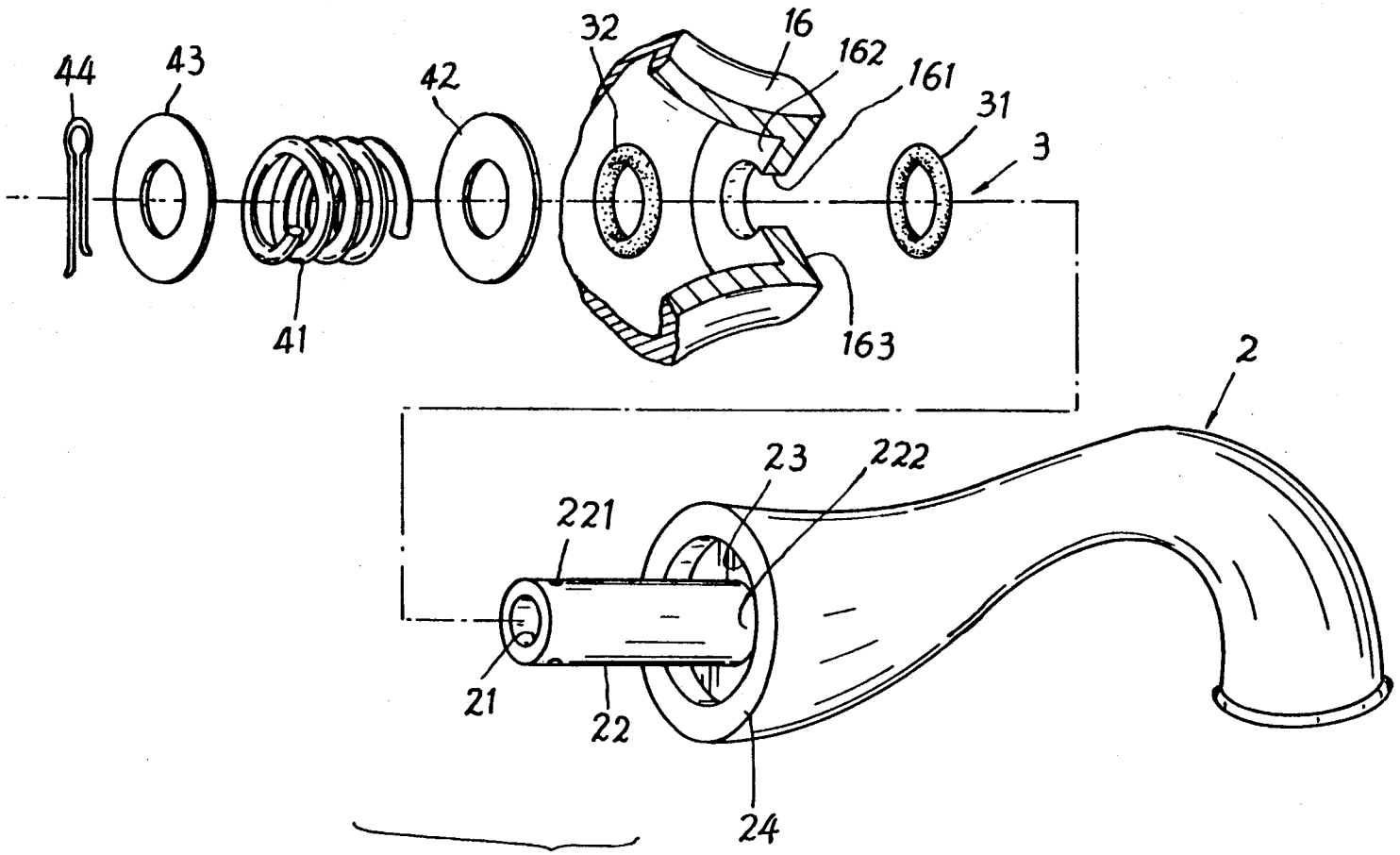
FIG. 2 is an exploded view of the present invention.

As shown in FIGS. 1 and 2, the present invention comprises: a faucet 1, a spout 2, a packing means 3, and a tensioning spring means 4.

The faucet 1 includes: a cylindrical bore portion 11 formed in a valve body 10 of the faucet, a valve seat 12 defining a valve opening 121 formed in a lower portion of the bore portion 11 communicating a water inlet, a valve plug 13 normally seating on the valve seat 12 for closing the valve opening 121 and operatively separated from the valve seat 12 for opening the valve opening 121 by a handle 14, an interior chamber 15 communicating the cylindrical bore portion 11 defined within a boss 16 protruding outwardly sidewardly from the valve body 10, and a cap 17 sealably mounted on a top portion of the valve body 10 for sealing a top opening 101 of the valve body 10 and for capping the cylindrical bore portion 11.

The boss 16 includes a central shaft hole 161 formed in a central portion of a boss seat 160 formed on an outer protruded end portion of the boss, an inner seat portion 162 formed on an inside surface of the seat 160, and an outer seat portion 163 formed on an outside surface of the seat 160 opposite to the inner surface of the seat 160.

The spout 2 includes: a central passage 21 formed through the spout 2 communicating the interior chamber 15 and the cylindrical bore portion 11 of the valve body 10, a shaft portion 22 protruding inwardly from the spout 2 about a longitudinal axis 100 longitudinally formed in a center portion of the shaft hole 161 of the boss 16 to be rotatably engaged with the central shaft hole 161 of the boss 16 having a pin hole 221 transversely formed in an inner end portion of the shaft portion 22, and an annular recess 23 annularly recessed in a shoulder portion 24 generally annular shaped formed on a base portion 222 of the shaft portion 22.

The shoulder portion 24 of the spout 2 is engagable with the outer seat portion 163 of the boss 16 of the faucet 1 about an interface 2*a* generally perpendicular to the longitudinal axis 100.

The packing means 3 includes an outer packing collar 31 embedded in the annular recess 23 of the spout 2 rotatably packed between the shoulder portion 24 and the outer seat portion 163, and an inner packing collar 32 jacketed on the shaft portion 22 of the spout 2 rotatably retained on the inner seat portion 162 of the boss 16 as urged by the tensioning spring means 4 secured on the shaft portion 22. The packing collars 31, 32 may be made of rubber or polyurethane material.

The tensioning spring means 4 includes: a tensioning spring 41 jacketed on the shaft portion 22 of the spout 2, an outer washer 42 retaining the inner packing collar 32 urged by an outer spring end of the tensioning spring 41, an inner washer 43 limiting an inner spring end of the tensioning spring 41, and a retainer pin 44 inserted in the pin hole 221 of the shaft portion 22 of the spout 2 for limiting the inner washer 43 on the shaft portion 22 for compressing the spring 41 for resiliently holding the packing collars 31, 32 and the spout 2 on the boss 16 of the faucet 1.

When dismantling the spout 2 from the faucet 1 of the present invention, the cap 17 is removed from the valve body 10, the retainer pin 44 is removed from the shaft portion 22 of the spout 2 to withdraw the spring 41, washers 42, 43 and inner packing collar 32 from the shaft portion 22 which is then pulled outwardly from the boss 16 for replacing new packing collars 32, 31.

A specially designed tool may be used to dismantle the spring means 4 of the present invention through the top opening 101 of the valve body 10.

For assembling the inner packing collar 32 and the spring means 4 onto the shaft portion 22 of the spout 2, the above-mentioned procedure is reversed to ratatably mount the spout 2 on the boss 16 of the faucet 1, By rotating the spout 2 about the axis 100 in direction R as shown in FIG. 1, the spout 2 can be rotated either upwardly or downwardly to discharge water stream from a nozzle 25 of the spout 2. Since the packing collars 31, 32 are resiliently packed in between the spout 2 and the boss 16 of the faucet 1, an excess operating pressure acting on the packing collars 31, 32 will be absorbed by the tensioning spring 41 to have a smooth rotation movement of the spout 2 and to reduce wearing of the packing means 3.

A thickness of the outer packing collar 31 is larger than a depth of the annular recess 23 to enhance a packing and sealing effect of the packing means 3 between the spout 2 and the faucet 1. Both packing collars 31, 32 are tightly fastened on the shaft portion 22 of the spout 2 and partitioned by the seat 160 formed on an protruded end portion of the boss 16.

The present invention is superior to a conventional faucet with rotational spout with the following advantages:

1. The packing collars 31, 32 are spring loaded, not deadly fixed in the faucet or spout, so that a smoother rotational operation of the spout 2 and a longer service life of the packing means 3 can be enhanced. Two packing collars 31, 32 will enforce a double packing purpose for preventing water leakage through an interface between the spout 2 and the boss 16.

2. The assembly and disassembling of the faucet elements can be easily done without the need of a professional plumber.

3. The mechanism and structure is so simple to reduce a production cost thereof.

The washers, spring, and retainer pin of this invention may be made of stainless steel or other corrosion-preventive materials.

The present invention may be further modified without departing from the spirit and scope of this invention. The shape, structure and arrangement of the valve body and the spout are also not limited in this invention.

I claim:

1. A faucet comprising:

a valve body having a boss formed on a side portion of the valve body defining an interior chamber in said boss, a bore portion communicating the interior chamber having a valve plug normally sealing on a valve seat defining a valve opening of a water inlet for a sealing said valve opening and operatively opening said valve opening by a handle formed on the valve body, and a cap capping a top opening of the bore portion;

a spout having a shaft portion protruding inwardly from said spout rotatably mounted in said boss having a packing means packed in between said boss and said spout; and a tensioning spring means secured on said shaft portion within said boss resiliently retaining said packing means on said boss and on said spout;

said boss including a central shaft hole formed in a central portion of a boss seat formed on an outer protruded end portion of the boss, an inner seat portion formed on an inside surface of the boss seat, and an outer seat portion formed on an outside surface of the boss seat opposite to the inner surface of the boss seat, said boss rotatably engageable with said spout; and said spout including: a central passage formed through the spout communicating the interior chamber and the bore portion of the valve body, a shaft portion protruding inwardly from the spout about a longitudinal axis longitudinally formed in a center portion of the shaft hole of the boss to be rotatably engaged with the central shaft hole of the boss as packed by said packing means having a pin hole transversely formed in an inner end portion of the shaft portion, and an annular recess annularly recessed in a shoulder portion generally annular shaped formed on a base portion of the shaft portion; said shoulder portion of the spout engaged with the outer seat portion of the boss of the faucet about an interface generally perpendicular to the longitudinal axis of said boss.

2. A faucet according to claim 1, wherein said packing means includes an outer packing collar embedded in the annular recess of the spout rotatably packed between the shoulder portion of the spout and the outer seat portion of the boss, and an inner packing collar jacketed on the shaft portion of the spout rotatably retained on the inner seat portion of the boss as urged by the tensioning spring means secured on the shaft portion.

3. A faucet according to claim 2, wherein said tensioning spring means includes: a tensioning spring jacketed on the shaft portion of the spout, an outer washer retaining the inner packing collar urged by an outer spring end of the tensioning spring, an inner washer limiting an inner spring end of the tensioning spring, and a retainer pin inserted in the pin hole of the shaft portion of the spout for limiting the inner washer on the shaft portion for compressing the spring for resiliently holding the inner and outer packing collars and the spout on the boss of the faucet.

4. A faucet according to claim 2, wherein said outer packing collar has a thickness larger than a depth of the annular recess of the spout to enhance a packing and sealing effect of the packing means between the spout and the faucet; said inner and outer packing collars being tightly fastened on the shaft portion of the spout and partitioned by the boss seat formed on a protruded end portion of the boss.

* * * * *